US006448703B1

(12) United States Patent
Jang

(10) Patent No.: US 6,448,703 B1
(45) Date of Patent: Sep. 10, 2002

(54) ELECTRODE UNIT WITH INVERTED DYNAMIC FOCUS VOLTAGE APPLIED THERETO FOR FORMING QUADRUPOLE LENS AND DYNAMIC FOCUS ELECTRON GUN USING THE SAME

(75) Inventor: Hyoung-Wook Jang, Suwon (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/333,947

(22) Filed: Jun. 16, 1999

(30) Foreign Application Priority Data

Dec. 2, 1998 (KR) ..... 98-52517

(51) Int. Cl.[7] ..... H01J 29/50

(52) U.S. Cl. ..... 313/412; 313/413; 313/414; 313/452; 315/3; 315/5.33; 315/382

(58) Field of Search ..... 313/412, 413, 313/414, 452; 315/3, 5.33, 5.34, 368.15, 382

(56) References Cited

U.S. PATENT DOCUMENTS 4,899,091 A * 2/1990 Odenthal ..... 315/382

5,281,896 A * 1/1994 Bae et al. ..... 315/15

* cited by examiner

*Primary Examiner*—Vip Patel
*Assistant Examiner*—Kevin Quarterman
(74) *Attorney, Agent, or Firm*—Lowe Hauptman Gilman & Berner, LLP

(57) ABSTRACT

An electron gun for a color cathode ray tube including a triode consisting of a cathode, a control electrode and a screen electrode, and first and second focus electrodes facing each other and installed sequentially from the triode, for forming quadrupole lenses for focusing and accelerating an electron beam emitted from the triode, wherein three first-elongated electron beam passing holes slanting in one direction at a predetermined angle with respect to the longitudinal axis are formed on the facing surface of the first focus electrode, and three second-elongated electron beam passing holes slanting in a direction opposite to that of the first-elongated electron beam passing holes at a predetermined angle with respect to the longitudinal axis are formed on the facing surface of the second focus electrode, and wherein a dynamic focus voltage synchronized with a deflection signal is applied to the first focus electrode and a focus voltage is applied to the second focus electrode.

4 Claims, 6 Drawing Sheets

ELECTRODE UNIT WITH INVERTED DYNAMIC FOCUS VOLTAGE APPLIED THERETO FOR FORMING QUADRUPOLE LENS AND DYNAMIC FOCUS ELECTRON GUN USING THE SAME

BACKGROUND OF THE INVENTION

1. Field of the Invention

The present invention relates to an electron gun for a cathode ray tube, and more particularly, to an electrode unit having improved electron beam passing holes for forming a quadrupole electronic lens of an electron gun and an electron gun for a cathode ray tube using the same.

2. Description of the Related Art

In general, a color cathode ray tube deflects an electron beam emitted from an electron gun by a deflection yoke in accordance with picture signals and lands the electron beam on a fluorescent screen, thereby forming a picture image. In order to obtain a cleaner picture image, it is important to land the electron beam emitted from the electron gun on an exact landing position of the fluorescent screen.

However, in the electron beam emitted from the electron gun and landing on the periphery of a screen after being deflected by the deflection yoke, the size of the beam spot becomes larger and the shape of the beam spot is distorted due to a non-uniform deflection magnetic field and a geometric curvature of a screen surface, which adversely affect, in particular, the resolution of a television necessitating a high definition such as a HDTV or a wide-vision television.

To overcome such problems, a dynamic focusing electron gun using a quadrupole lens has been employed, in which the shape of an electron beam is deformed in advance and focal lengths of the electron beam when it lands on the center and periphery of the screen are made different. In order to form the quadrupole lens, a dynamic voltage synchronized with a deflection signal and a focus voltage are applied to a plurality of electrodes on which electron beam passing holes are formed, or two dynamic focus voltages and two focus voltages are applied thereto, respectively.

FIG. 1 shows an example of electrodes forming the quadrupole lens.

As shown in the drawing, a vertically elongated electron beam passing hole 11*h* is formed on a first electrode 11, and a horizontally elongated electron beam passing hole 12*h* is formed on a second electrode 12 which is disposed opposite to the first electrode 11. A predetermined focus voltage is applied to the first electrode 11, and a dynamic focus voltage synchronized with a deflection signal produced when an electron beam is deflected toward the periphery of the screen is applied to the second electrode 12.

Since the first and second electrodes 11 and 12 forming the above-described quadrupole lens have the electron beam passing holes 11*h* and 12*h* elongated vertically and horizontally, respectively, the electron beam passing through the quadrupole lens converges horizontally and diverges vertically so that its cross section becomes vertically elongated. Thus, the distortion of the electron beam, which is formed by a Lorentz force when the electron beam passes through a non-uniform magnetic field formed by a deflection yoke, and the distortion of the electron beam of the periphery of the phosphor screen can be compensated for.

However, the electrodes forming the quadrupole lens cannot satisfactorily compensate for the cross sectional distortion of the electron beam landing at the corners of the phosphor screen . In other words, even if the cross section of the electron beam is vertically elongated, since the electron beam deflected diagonally with respect to the screen lands at the corners of the screen, the cross sectional distortion of the electron beam cannot be completely compensated for.

SUMMARY OF THE INVENTION

To solve the above problems, it is an objective of the present invention to provide an electrode unit which can prevent cross sectional distortion of electron beams landing throughout the screen and enhance the resolution of a cathode ray tube by improving focus characteristics of the electron beams, and an electron gun for a color cathode ray tube employing the electrode unit.

Accordingly, to achieve the above objective, there is provided an electrode unit for forming a quadrupole lens including a first electrode having three first-elongated electron beam passing holes slanting in one direction at a predetermined angle with respect to the longitudinal axis, and a second electrode having three second-elongated electron beam passing holes slanting in a direction opposite to that of the first-elongated electron beam passing holes at a predetermined angle with respect to the longitudinal axis.

Also, there is provided an electron gun for a color cathode ray tube including a triode consisting of a cathode, a control electrode and a screen electrode, and first and second focus electrodes facing each other and installed sequentially from the triode, for forming quadrupole lenses for focusing and accelerating an electron beam emitted from the triode, wherein three first-elongated electron beam passing holes slanting in one direction at a predetermined angle with respect to the longitudinal axis are formed on the facing surface of the first focus electrode, and three second-elongated electron beam passing holes slanting in a direction opposite to that of the first-elongated electron beam passing holes at a predetermined angle with respect to the longitudinal axis are formed on the facing surface of the second focus electrode, and wherein a dynamic focus voltage synchronized with a deflection signal is applied to the first focus electrode and a focus voltage is applied to the second focus electrode.

According to another aspect of the present invention, there is provided an electron gun for a color cathode ray tube including a triode consisting of a cathode, a control electrode and a screen electrode, a pair of first focus electrodes facing each other for forming a first quadrupole lens for focusing and accelerating an electron beam emitted from the triode, and a pair of second focus electrode facing each other for forming a second quadrupole lens for focusing and accelerating an electron beam having passed through the first quadrupole lens, wherein three first-elongated electron beam passing holes slanting in one direction at a predetermined angle with respect to the longitudinal axis are formed on the facing surface of one of the first focus electrodes, three second-elongated electron beam passing holes slanting in a direction opposite to that of the first-elongated electron beam passing holes at a predetermined angle with respect to the longitudinal axis are formed on the facing surface of the other of the first focus electrodes, and wherein a vertically elongated electron beam passing hole is formed on the facing surface of one of the second focus electrodes and a horizontally elongated electron beam passing hole is formed on the facing surface of the other of the second focus electrodes.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 1:
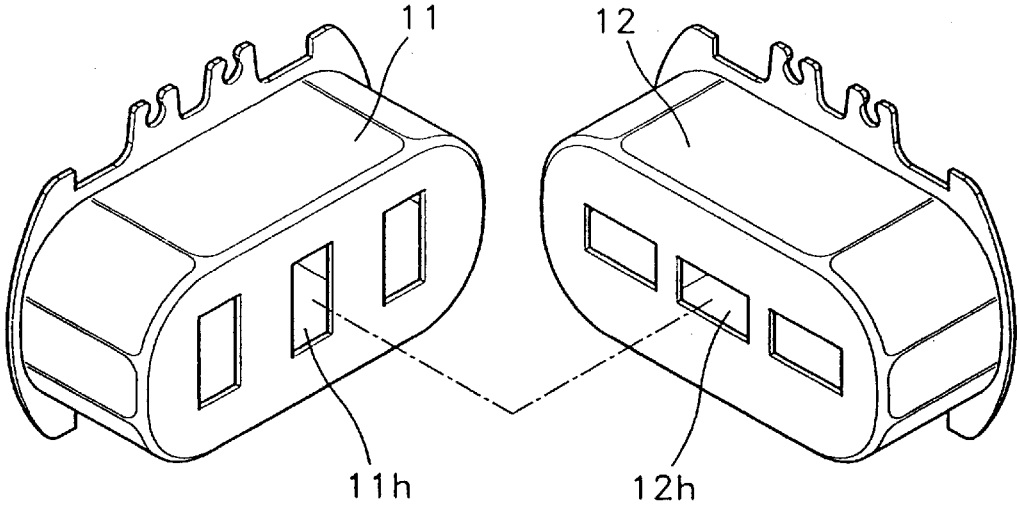
FIG. 1 PRIOR ART
FIG. 1 is an exploded perspective view of an electrode unit for forming a conventional quadrupole lens.
Figure 2:
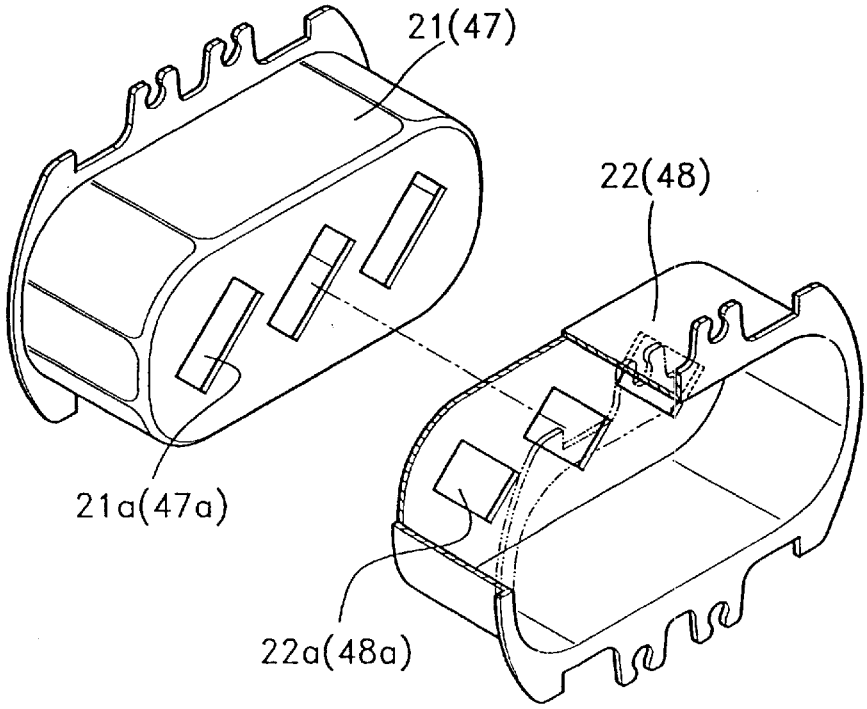
FIG. 2 is an exploded perspective view of an electrode unit for forming a quadrupole lens according to the present invention.

FIG. 2 shows an electrode unit for forming a quadrupole lens according to an embodiment of the present invention.

Referring to FIG. 2, a first elongated electron beam passing hole 21*a* slanting in one direction by 45° with respect to a longitudinal axis is formed on a first electrode 21 positioned at a beam entering side, and a second elongated electron beam passing hole 22*a* slanting in a direction opposite to that of the first elongated electron beam passing hole 21*a* by 45° with respect to the longitudinal axis is formed on a second electrode 22 facing the first electrode 21. The first and second elongated electron beam passing holes 21*a* and 22*a* are preferably rectangular.

Figure 3:
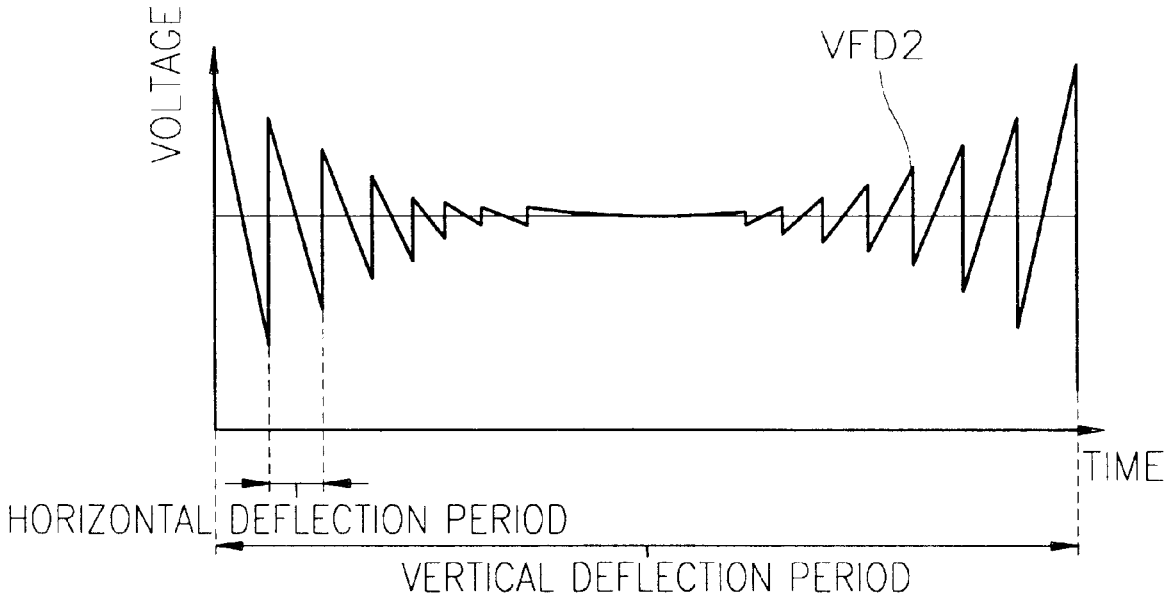
FIG. 3 is a waveform diagram of a voltage applied to the electrode unit for forming a quadrupole lens.

A predetermined focus voltage is applied to the first electrode 21 and a dynamic focus voltage (VFD2 of FIG. 3) synchronized with a deflection signal is applied to the second electrode 22. The dynamic focus voltage VFD2, as shown in FIG. 3, is inverted from a positive potential to a negative potential and has a serrated waveform in which the amplitude of the voltage decreases according to the passage of time and then increases again symmetrically with respect to the decreasing voltages. Here, the period during which the potentials are inverted is the same as the horizontal deflection period of a deflection yoke, and the period during which the original amplitude of the voltage is restored is the same as the vertical deflection period of the deflection yoke.

Figure 4:
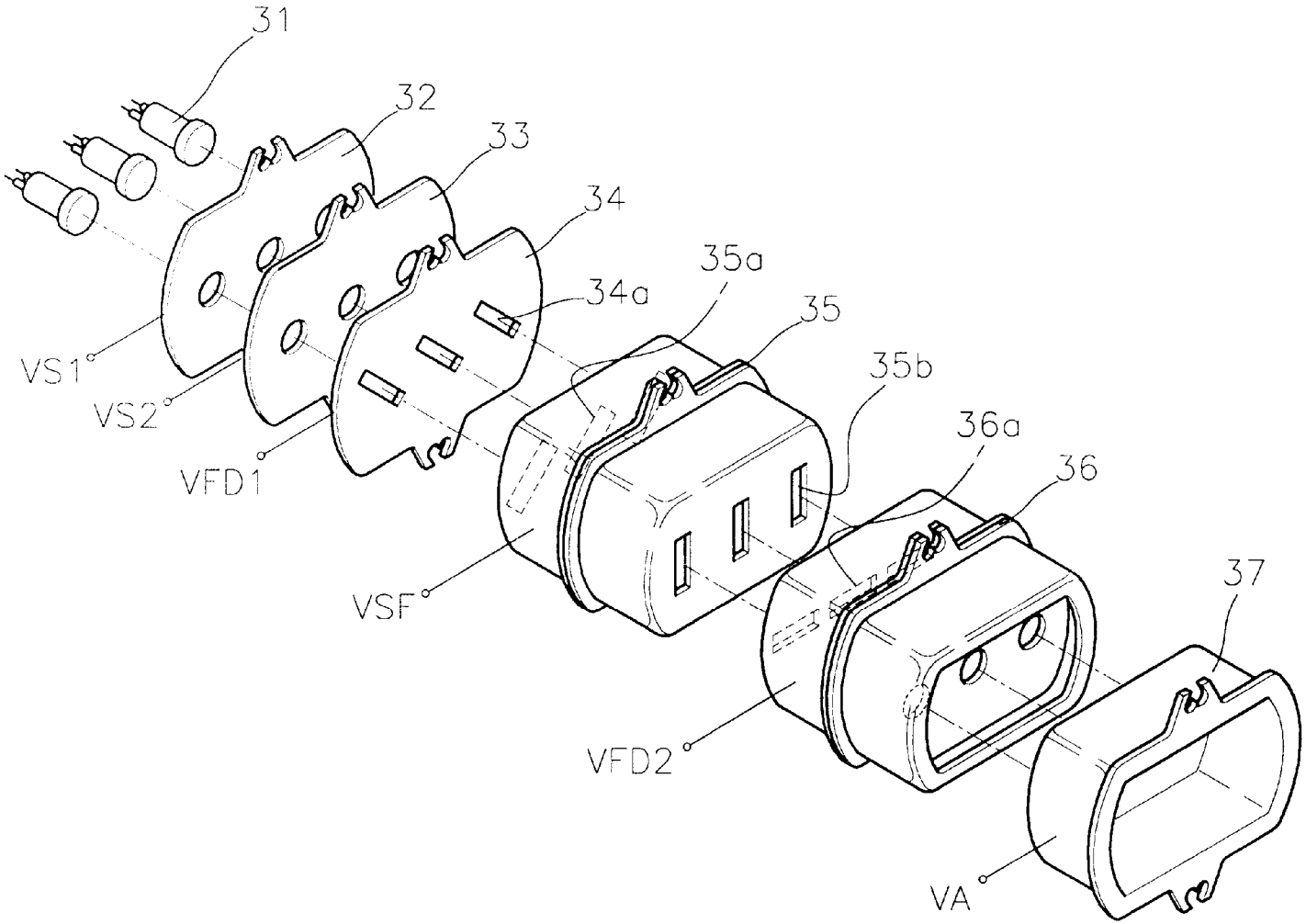
FIG. 4 is an exploded perspective view of an electron gun for a color cathode ray tube according to an embodiment of the present invention.

FIG. 4 illustrates an embodiment of an electron gun for a color cathode ray tube, employing an electrode unit for forming the quadrupole lens, according to the present invention.

As shown in the drawing, the electron gun for a color cathode ray tube according to an embodiment of the present invention comprises a triode consisting of a cathode 31 for emitting electron beams, a control electrode 32 and a screen electrode 33. First, second and third focus electrodes 34, 35 and 36 which form at least one circular lens and at least one quadrupole lens for pre-focusing and accelerating the electron beams emitted from the triode are sequentially installed adjacent to the screen electrode 33. Also, a final accelerating electrode 37 is installed adjacent to the third focus electrode 36.

Here, three electron beam passing holes for forming an electronic lens are formed on each electrode. In other words, a first elongated electron beam passing hole 34*a* slanting in one direction by 45° with respect to a longitudinal axis is formed on the first focus electrode 34, and a second elongated electron beam passing hole 35*a* slanting in a direction opposite to that of the first elongated electron beam passing hole 34*a* by 45° with respect to the longitudinal axis is formed at a beam entering side of the second focus electrode 35. The slanting angle of the first and second elongated electron beam passing holes 34*a* and 35*a* with respect to the longitudinal axis is not limited to 45 degrees but may be varied in accordance with a curvature of the screen or a deflection angle of the electron beam caused by the deflection angle.

A vertically elongated electron beam passing hole 35*b* and a horizontally elongated electron beam passing hole 36*a* are formed on a beam emitting side of the second focus electrode 35 and on a beam entering side of the third focus electrode 36, respectively.

During operation of the electron gun, a static voltage VS1 of 0 to −60 V is applied to the control electrode 32, a static voltage VS2 of 400 to 600 V is applied to the screen electrode 33, a first dynamic focus voltage VFD1 being in the range of 25–28% of an anode voltage VA to be described later is applied to the first focus electrode 34, a focus voltage VSF is applied to the second focus electrode 35 and a second dynamic focus voltage VFD2 synchronized with a deflection signal of the deflection yoke is applied to the third focus electrode 36.

The change in the first dynamic focus voltage according to the passage of time has been described, as shown in FIG. 3. The anode voltage VA of 30 to 35 kV is applied to the final accelerating electrode 37. The voltage applied to the respective electrodes is not restricted but can be varied.

The action of the quadrupole lens will now be described by the operation of the aforementioned electron gun for a color cathode ray tube according to the present invention.

If various voltages described above are applied to the respective electrodes, electronic lenses are formed among the electrodes. Here, when the electron beam emitted from the cathode 31 lands on the center of a screen (not shown), since the first and second dynamic focus voltages VFD1 and VFD2 are not applied to the first and third focus electrode 34 and 36, the electron beam is focused and accelerated by a pre-focusing lens formed between the screen electrode 33 and the first focus electrode 34, focusing lenses formed among the first, second and third focus electrodes 34, 35 and 36 and a main lens formed between the third focus electrode 36 and the final accelerating electrode 37 to then land on the center of the screen. Here, the cross section of the electron beam landing on the center of the screen becomes circular.

When the electron beam is deflected toward the periphery of the screen, the first dynamic focus voltage VFD1 and the second dynamic focus voltage VFD2 which is synchronized with the deflection signal are applied to the second focus electrode 35 and the first and third focus electrode 34 and 36, respectively. Then, a pre-focusing lens is formed between the screen electrode 33 and the first focus electrode 34, and quadrupole lenses are formed between the first and second focus electrodes 34 and 35 and between the second and third focus electrode 35 and 36. Also, a main lens having a relatively low magnification is formed between the third focus electrode 36 and the final accelerating electrode 37.

Figure 5A:
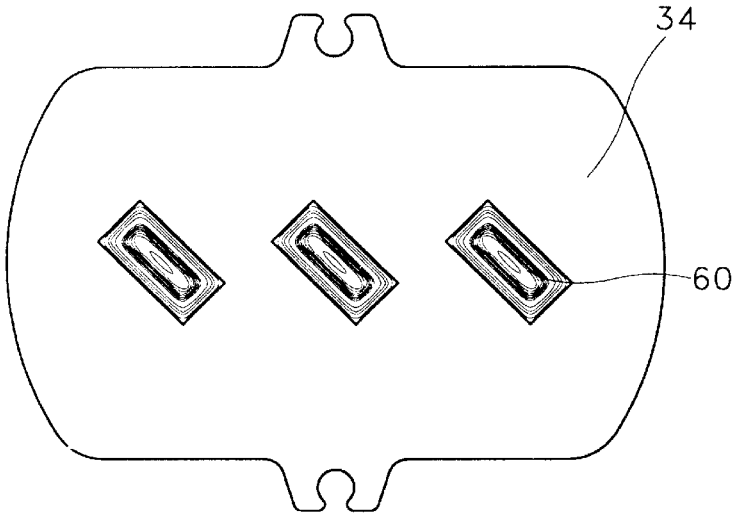
FIGS. 5A and 5B illustrate the distribution of electric fields formed at the electrode unit for forming the quadrupole lens employed to the cathode ray tube shown in FIG. 4.
Figure 5B:
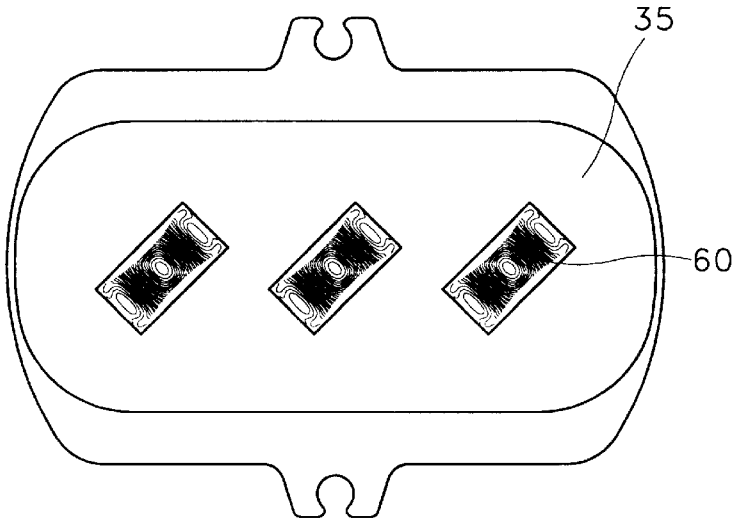

Since the first and second elongated electron beam passing holes 34*a* and 35*a* formed on facing surfaces of the first and second focus electrodes 34 and 35 are slanted in opposite directions to each other at a predetermined angle with respect to the longitudinal axis, the quadrupole lenses are asymmetrically formed by the distribution of equipotential lines 60 shown in FIGS. 5A and 5B. Thus, the electron beam converges weakly in the vertical direction and intensely in the horizontal direction while passing through the quadrupole lenses, and the cross section thereof becomes vertically elongated.

In particular, the voltage applied to the first focus electrode 34 is varied in accordance with the vertical deflection period of the deflection yoke such that the amplitude of the voltage increases toward the starting and ending points of the vertical deflection period in view of the middle thereof, as shown in FIG. 3. Thus, when the electron beam is deflected toward the periphery of the screen, the distribution density of the magnetic field which forms the quadrupole lenses becomes high. Therefore, as the electron beam is projected on a portion farther from the center of the screen, the cross section of the electron beam is maintained to be vertically elongated.

Figure 6:
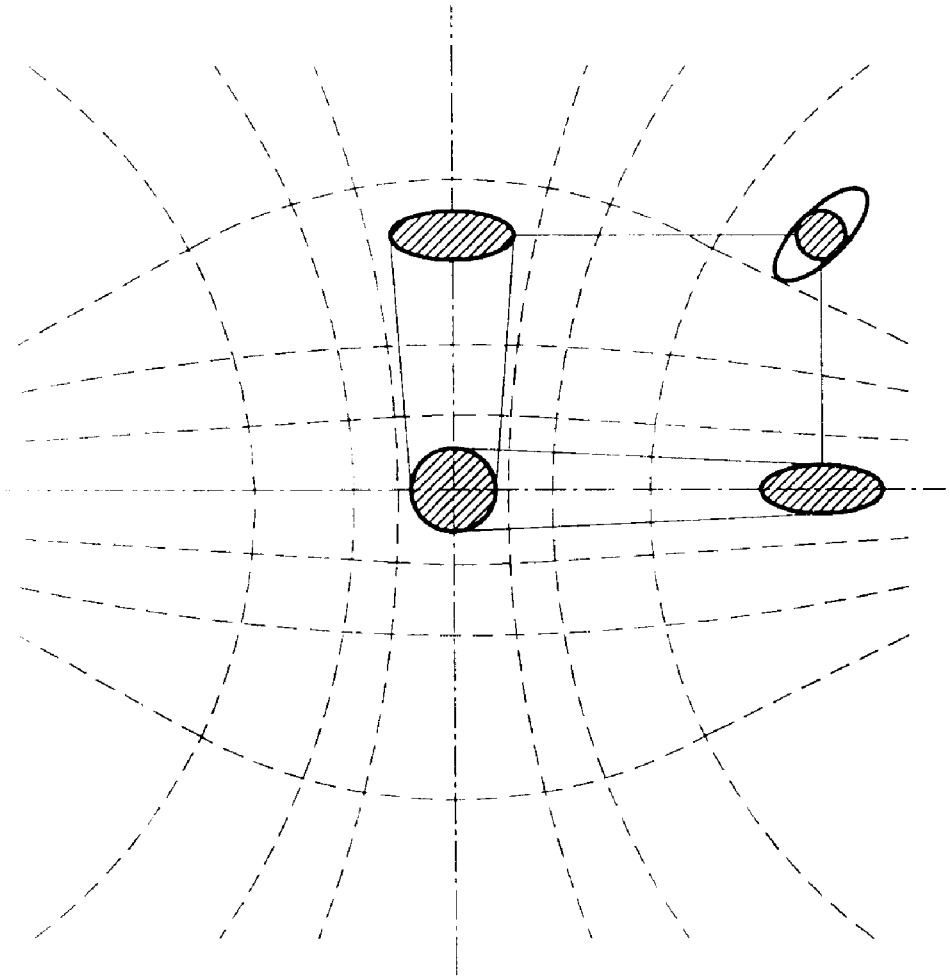
FIG. 6 illustrates the state in which an electron beam is deflected by a non-uniform magnetic field of a deflection yoke in the electron gun shown in FIG. 4.

The electron beam slanting with respect to the longitudinal axis and vertically elongated is distorted in a horizontal direction by a Lorentz effect, as shown in FIG. 6, when it is deflected toward the periphery of the screen by the deflection magnetic field of the deflection yoke. Thus, the cross section of the electron beam at the periphery of the screen is substantially circular. A slight difference may be generated in the substantially circular shapes in accordance with the curvature of the screen and deflected direction of the electron beam.

Figure 7:
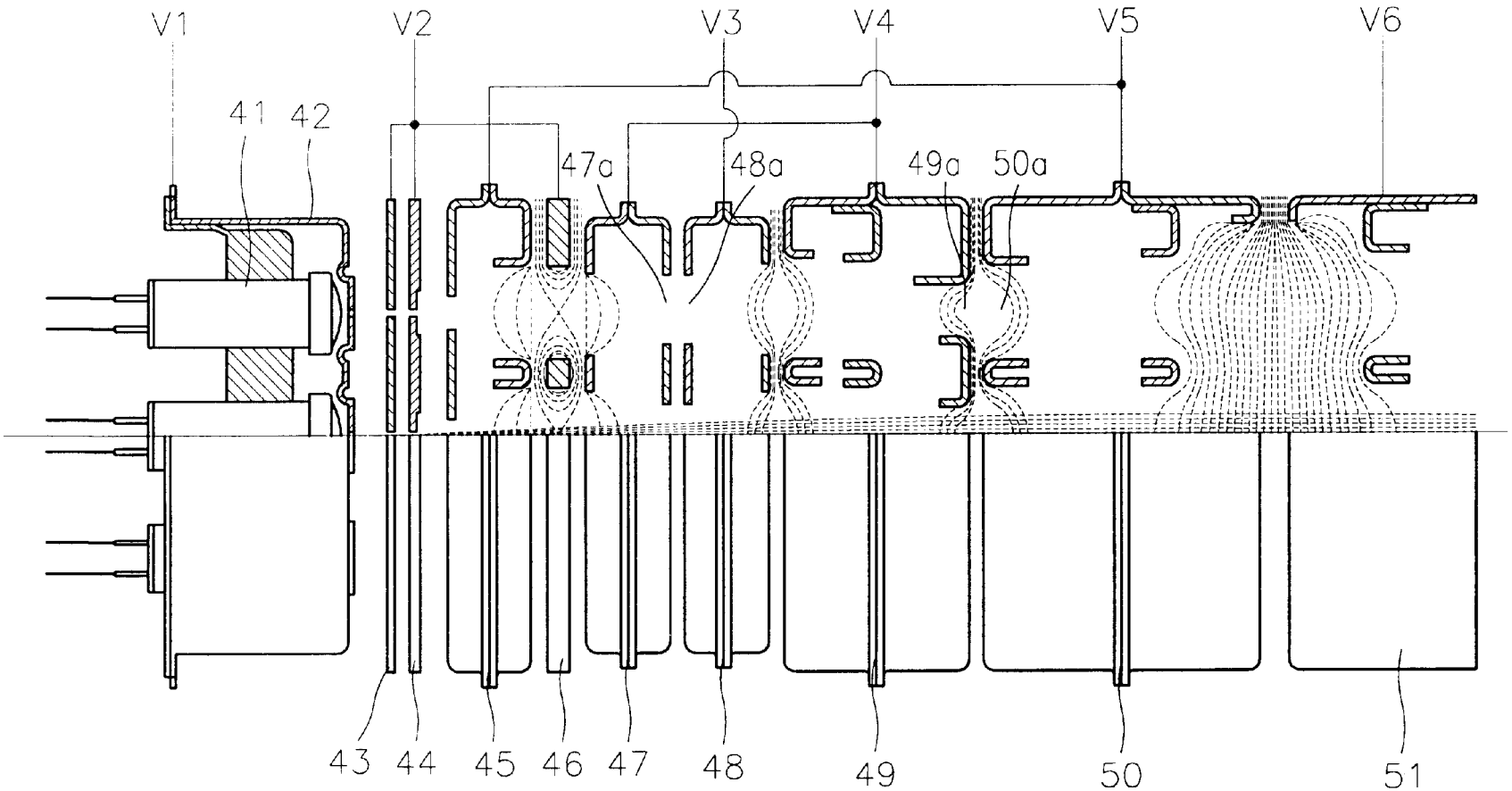
FIG. 7 is a cross-sectional view of an electron gun for a color cathode ray tube according to another embodiment of the present invention.

FIG. 7 is a cross-sectional view of an electron gun for a color cathode ray tube according to another embodiment of the present invention.

As shown in the drawing, a triode consists of a cathode 41, a control electrode 42 and a screen electrode 43. The electron beam emitted from the triode is pre-focused and accelerated by first through seventh focus electrodes 44 through 50. The first through seventh focus electrodes 44 through 50 are installed sequentially from the screen electrode 43 and form a plurality of focusing lenses and a plurality of quadrupole lenses. Also, a final accelerating electrode 51 is installed adjacent to the seventh focus electrode 50.

Here, three electron beam passing holes for forming electronic lenses are formed on each electrode. Electron beam passing holes having the same shapes as that of the electron beam passing holes 21*a* and 22*a* shown in FIG. 2 are formed on the fourth and fifth focus electrodes 47 and 48. In other words, a third elongated electron beam passing hole 47*a*slanting in one direction by 45° with respect to a longitudinal axis is formed at a beam emitting side of the fourth focus electrode 47, and a fourth elongated electron beam passing hole 48*a* slanting in a direction opposite to that of the third elongated electron beam passing hole 47*a* by 45° with respect to the longitudinal axis is formed at a beam entering side of the fifth focus electrode 48. A vertically elongated electron beam passing hole 49*a* and a horizontally elongated electron beam passing hole 50*a* are formed on a beam emitting surface of the sixth focus electrode 49 and a beam entering surface of the seventh focus electrode 50, respectively.

During operation of the electron gun, a static voltage V1 is applied to the control electrode 42, a voltage V2 higher than the static voltage V1 is applied to the screen electrode 43, the first focus electrode 44 and the third focus electrode 46. A dynamic focus voltage V3 synchronous with a deflection signal is applied to the fifth focus electrode 48. A voltage V4 is applied to the fourth and sixth focus electrodes 47 and 49, a voltage V5 is applied to the second and seventh focus electrode 45 and 50, and a voltage V6 equal to the voltage applied to an inner conductive film (not shown) is applied to the final accelerating electrode 51. The intensities of the voltages applied to the respective electrodes can be adjusted in consideration of magnifications of electronic lenses.

In the above-described electron gun, focusing lenses and quadrupole lenses are formed with the above voltages applied. The action of the quadrupole lens formed by the fourth and fifth focus electrodes 47 and 48 is the same as described in the above-described embodiment. Also, since a plurality of focus electrodes for forming the focusing lenses are installed in front of the focusing electrodes for forming the quadrupole lenses, the incidence angle of an electron beam entering toward the quadrupole lenses can be reduced by focusing the electron beams by means of the focusing lenses in multiple stages.

According to the electrode unit for forming a quadrupole lens of the present invention and a dynamic focus electron gun using the same, the cross section of the electron beam landing on the periphery of the screen is made to slant and to be vertically elongated and a voltage having a serrated waveform is applied such that the amplitude of the voltage increases as the landing point of the electron beam becomes farther from the center of the screen. By doing so, the cross section of the electron beam is maintained to be circular on the periphery of the screen. Thus, a uniform cross section of the electron beam can be attained throughout the screen, thereby enhancing the resolution of a picture image.

Although the present invention has been described with reference to illustrative embodiments, these are only provided by way of example and various changes and modifications may be effected by one skilled in the art within the scope of the invention as defined in the appended claims.

What is claimed is:

1. An electrode unit for use as a quadrupole lens in a cathode ray tube utilizing a deflection yoke to deflect an electron beam in first and second deflection directions during first and second deflection periods, respectively, said electrode unit comprising:

a first electrode having at least one first elongated electron beam passing hole; and a second electrode having at least one second elongated electron beam passing hole corresponding to said at least one first elongated electron beam passing hole;

wherein the first and second electron beam passing holes are elongated and slanted respectively in first and second directions disposed symmetrically with respect to the first deflection direction; and wherein a dynamic focus voltage is applied to the second electrode, said dynamic focus voltage having a serrated waveform including first and second intervals symmetrical in time a sum of which being substantially equal to the first deflection period of the deflection yoke, said dynamic focus voltage repeatedly oscillating between a positive potential and a negative potential with a period substantially equal to the second deflection period of the deflection yoke, said dynamic focus voltage further having an amplitude decreasing during the first interval and increasing during the second intervals symmetrically with respect to the first interval.

2. The electrode unit of claim 1, wherein the first and second deflection directions are vertical and horizontal directions, respectively.

3. The electrode unit of claim 1, wherein the first and second electrodes include three first and second elongated electron beam passing holes, respectively.

4. An electron gun for use in a cathode ray tube having mutually orthogonal X, Y and Z directions, said electron gun comprising:

a triode for emitting electron beams in the Z direction, the triode including a cathode, a control electrode and a screen electrode; and first and second focus electrodes facing each other and installed sequentially downstream of the triode, for forming quadrupole lenses for focusing and accelerating the electron beams toward a deflection yoke used to deflect the electron beams in the X and Y directions in accordance with a deflection signal;

wherein the first electrode has a plurality of first elongated electron beam passing holes, the second electrode has a plurality of second elongated electron beam passing holes each aligned with one of the first elongated electron beam passing holes to define an electron beam path for one of the electron beams, and the first and second electron beam passing holes are elongated and slanted respectively in first and second directions disposed symmetrically with respect to the Y direction; and wherein a dynamic focus voltage synchronized with the deflection signal is applied to the first focus electrode while a focus voltage is applied to the second focus electrode;

wherein the dynamic focus voltage has a serrated waveform including first and second intervals symmetrical in time a sum of which is substantially equal to a first deflection period during which the deflection yoke deflects the electron beams in the Y direction;

the dynamic focus voltage repeatedly oscillates between a positive potential and a negative potential with a period substantially equal to a second deflection period during which the deflection yoke deflects the electron beams in the X direction; and the dynamic focus voltage further has an amplitude decreasing during the first interval and increasing during the second intervals symmetrically with respect to the first interval.

* * * * *